US011939990B2

(12) United States Patent
Lin

(10) Patent No.: US 11,939,990 B2
(45) Date of Patent: Mar. 26, 2024

(54) FAN STRUCTURE

(71) Applicant: Coretronic Corporation, Hsin-Chu (TW)

(72) Inventor: Shih-Hang Lin, Hsin-Chu (TW)

(73) Assignee: Coretronic Corporation, Hsin-Chu (TW)

( * ) Notice: Subject to any disclaimer, the term of this patent is extended or adjusted under 35 U.S.C. 154(b) by 0 days.

(21) Appl. No.: 17/727,866

(22) Filed: Apr. 25, 2022

(65) Prior Publication Data

US 2022/0349420 A1 Nov. 3, 2022

(30) Foreign Application Priority Data

Apr. 30, 2021 (CN) ..... 202120928113.3

(51) Int. Cl.
*F04D 29/38* (2006.01)
*F04D 19/00* (2006.01)

(52) U.S. Cl.
CPC ..... *F04D 29/38* (2013.01); *F04D 19/002* (2013.01)

(58) Field of Classification Search
CPC ..... F04D 29/38; F04D 19/002; F04D 29/666; F04D 29/668; F04D 29/282; F04D 29/283
See application file for complete search history.

(56) References Cited

U.S. PATENT DOCUMENTS 3,231,177 A * 1/1966 Williams ..... F04D 29/283 416/220 A
5,165,855 A * 11/1992 Ricketts ..... F04D 29/283 416/214 R
5,611,667 A * 3/1997 Nagamori ..... F04D 29/666 416/200 R
6,179,566 B1 * 1/2001 Andulics ..... B63H 1/20 416/178
6,416,285 B1 * 7/2002 Fichter ..... B23P 15/006 416/213 A
8,317,478 B2 11/2012 Higo et al.
8,753,086 B2 6/2014 Higo et al.
2003/0077174 A1 * 4/2003 Kim ..... F04D 29/283 416/185
2003/0235496 A1 * 12/2003 Eaton ..... F04D 29/283 415/206

(Continued)

FOREIGN PATENT DOCUMENTS

CN 111872353 11/2020
WO 2009135698 11/2009

*Primary Examiner* — Aaron R Eastman
(74) *Attorney, Agent, or Firm* — JCIPRNET

(57) ABSTRACT

A fan structure including a center portion, multiple fan blades, and a fixing ring is provided. The center portion includes a bottom surface and a center shaft. The center shaft is perpendicular to the bottom surface, and the direction in which the center shaft extends is an axial direction. The fan blades are mutually separated and connected to the bottom surface of the center portion and are disposed around the axial direction. Each of the fan blades has a height which is parallel to the axial direction. The fixing ring simultaneously contacts the side of the fan blades which is away from the center shaft. Along the axial direction, with the bottom surface of the center portion as a reference surface, the fixing ring is disposed at a range of 40% to 80% of the height of each of the fan blades.

10 Claims, 3 Drawing Sheets

(56) References Cited

U.S. PATENT DOCUMENTS

| | | | | |
|---|---|---|---|---|
| 2005/0047916 | A1* | 3/2005 | Li | F04D 29/283 416/186 R |
| 2008/0075598 | A1* | 3/2008 | Chen | F04D 29/283 416/179 |
| 2010/0158689 | A1* | 6/2010 | Nishino | F04D 29/283 416/213 A |
| 2012/0171013 | A1* | 7/2012 | Ohtsuka | F04D 17/04 425/542 |
| 2012/0177477 | A1* | 7/2012 | Shiraichi | F04D 29/283 415/53.1 |
| 2012/0201680 | A1* | 8/2012 | Hall | F01D 5/14 416/223 R |
| 2012/0263573 | A1* | 10/2012 | Tadokoro | F04D 29/283 415/53.1 |
| 2013/0004329 | A1* | 1/2013 | Shiraichi | F04D 17/10 416/243 |
| 2013/0101405 | A1* | 4/2013 | Shiraichi | F04D 17/04 415/191 |
| 2013/0101408 | A1* | 4/2013 | Shiraichi | F04D 29/681 415/203 |
| 2013/0336793 | A1* | 12/2013 | Shiraichi | B64C 23/06 416/178 |
| 2014/0301825 | A1* | 10/2014 | Tian | F04D 17/04 415/53.1 |
| 2015/0044051 | A1* | 2/2015 | Van Deventer | F04D 29/283 416/204 R |
| 2015/0064011 | A1 | 3/2015 | Xu et al. | |
| 2015/0118054 | A1* | 4/2015 | Zerelles | F04D 29/681 416/178 |
| 2015/0252816 | A1* | 9/2015 | Nakai | F04D 29/283 416/178 |

* cited by examiner

FAN STRUCTURE

CROSS-REFERENCE TO RELATED APPLICATION

This application claims the priority benefit of China application serial no. 202120928113.3, filed on Apr. 30, 2021. The entirety of the above-mentioned patent application is hereby incorporated by reference herein and made a part of this specification.

BACKGROUND

Technical Field

The disclosure relates to a heat dissipation structure, and in particular, to a fan structure.

Description of Related Art

Conventional blowers may be divided into two types based on the height of fan blades. One type is that the height of the fan blades is far less than the chord length of the fan blades. The overall size is relatively flat, and the overall structure is more solid since the height of the fan blades is smaller. The other type is that the height of the fan blades is larger. To prevent deformation of the fan blades during manufacturing or operation, the fan blades are usually fixed with a structure designed on the top and at the bottom of the fan blades. Generally, the structure at the bottom is usually a bottom plate to which all the fan blades are connected with one end. The structure on the top is a structure ring to which all the fan blades are connected with the other end, and the fan blades are fixed with the structure ring.

With regard to a blower with the fan blades with a larger height, when a fluid (for example, airflow) is pulled in the blower from the top, the high pressure generated in a flow channel may press the fluid toward the low-pressure part near an air inlet, which means the fluid may flow reversely toward the air inlet. As a result, the flow field near the air inlet on the top is not fluent, and a chaotic backflow area is formed. Since the top of the fan blades is where the structure ring is located and is near the air inlet where the high pressure and the low pressure meets, noise is generated easily, causing a user to have an undesirable user experience.

The information disclosed in this Background section is only for enhancement of understanding of the background of the described technology and therefore it may contain information that does not form the prior art that is already known to a person of ordinary skill in the art. Further, the information disclosed in the Background section does not mean that one or more problems to be resolved by one or more embodiments of the invention was acknowledged by a person of ordinary skill in the art.

SUMMARY

The disclosure is directed to a fan structure, which reduces noise generated during operation.

Other objectives and advantages of the disclosure will be further understood from the further technological features disclosed by the embodiments of the disclosure.

To achieve one of, a part of, or all of the objectives above or other objectives, an embodiment of the disclosure provides a fan structure, which includes a center portion, multiple fan blades and a fixing ring. The center portion includes a bottom surface and a center shaft. The center shaft is perpendicular to the bottom surface, and a direction in which the center shaft extends is an axial direction. The fan blades are mutually separated and connected to the bottom surface of the center portion and are disposed around the axial direction. Each of the fan blades has a height which is parallel to the axial direction. The fixing ring simultaneously contacts the fan blades at a side of the fan blades which is away from the center shaft. Along the axial direction, with the bottom surface of the center portion as a reference surface, the fixing ring is disposed within a range of 40% to 80% of the height of each of the fan blades.

In light of the above, the embodiment of the disclosure has at least one of the following advantages or effects. In the fan structure of the disclosure, with the bottom surface of the center portion as the reference surface, the fixing ring is disposed within the range of 40% to 80% of the height of each of the fan blades. That is, the fixing ring of the disclosure is not located at an air inlet where high pressure and low pressure meets so that the fan blades are effectively fixed and noise is also prevented. In brief, the fan structure of the disclosure reduces noise generated during operation so that the user has a better user experience.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

In the following detailed description of the preferred embodiments, reference is made to the accompanying drawings which form a part hereof, and in which are shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items.

Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component directly faces "B" component or one or more additional components are between "A" component and "B" component. Also, the description of "A" component "adjacent to" "B" component herein may contain the situations that "A" component is directly "adjacent to" "B" component or one or more additional components are between "A" component and "B" component. Accordingly, the drawings and descriptions will be regarded as illustrative in nature and not as restrictive.

Figure 1:
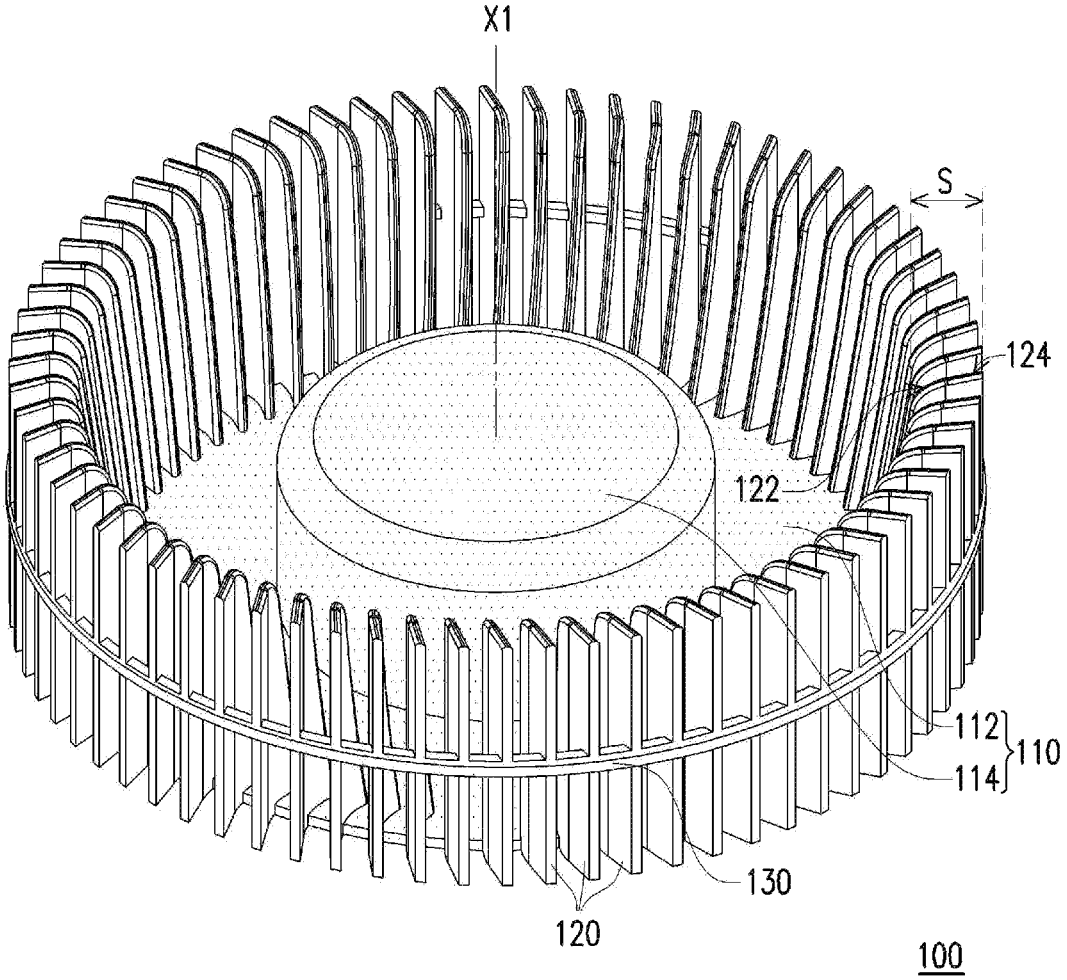
FIG. 1 is a schematic structural diagram of a fan structure according to an embodiment of the disclosure.
Figure 2:
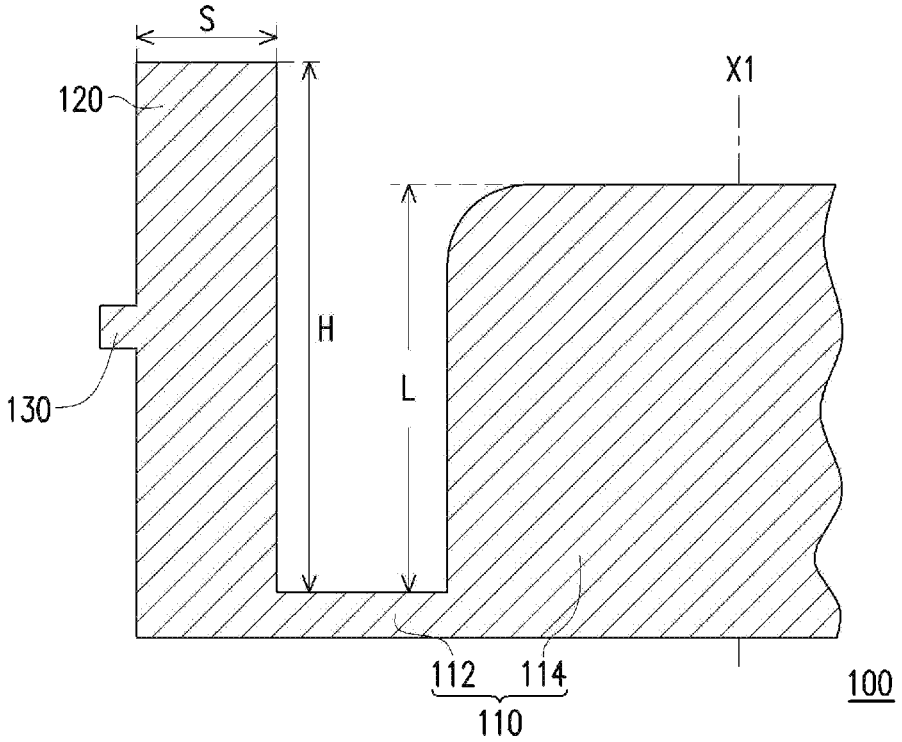
FIG. 2 and FIG. 3 are respectively simple schematic sectional diagrams of the fan structure in FIG. 1.
Figure 3:
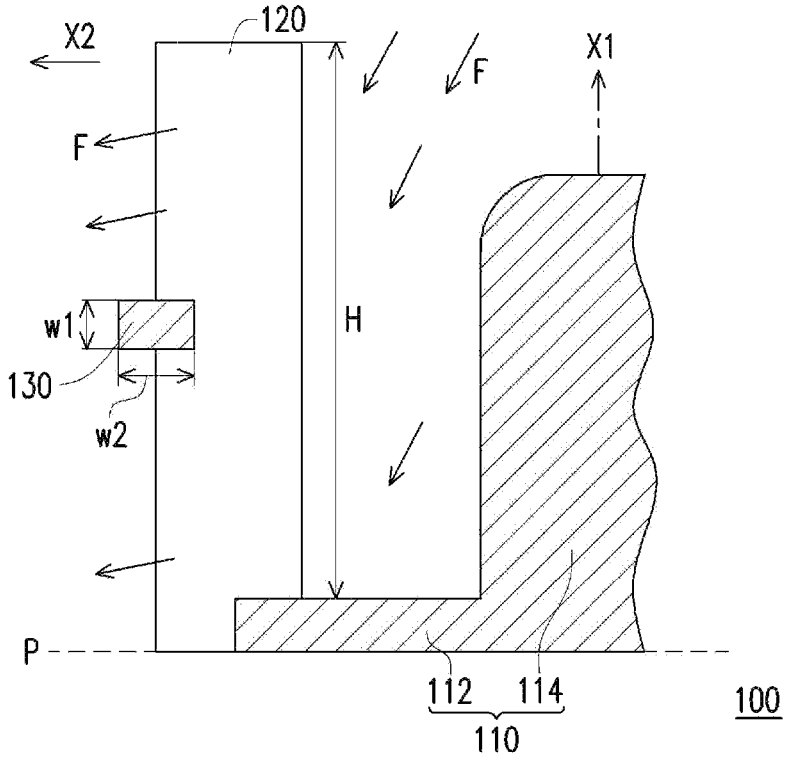

FIG. 1 is a schematic structural diagram of a fan structure according to an embodiment of the disclosure. FIG. 2 and FIG. 3 are respectively simple schematic sectional diagrams of the fan structure in FIG. 1.

Referring to FIG. 1 and FIG. 2 together, in the embodiment, a fan structure 100 includes a center portion 110, multiple fan blades 120, and a fixing ring 130. The center portion 110 includes a bottom surface 112 and a center shaft 114. The center shaft 114 is perpendicular to the bottom surface 112, and a direction in which the center shaft 114 extends is an axial direction X1. The fan blades 120 are mutually separated and connected to the bottom surface 112 of the center portion 110 and are disposed around the axial direction X1. Each of the fan blades 120 has a height H which is parallel to the axial direction X1. The fixing ring 130 simultaneously contacts the fan blades 120 at a side of the fan blades 120 which is away from the center shaft 114. Particularly, along the axial direction X1, with the bottom surface 112 of the center portion 110 as a reference surface, the fixing ring 130 is disposed within a range of 40% to 80% of the height H of each of the fan blades 120. In other words, the fixing ring 130 of the embodiment is not located at an air inlet where high pressure and low pressure meets, but, instead, it is located at a region in the middle of the height of the fan blades 120. Accordingly, the fan blades 120 may be effectively fixed, and noise may also be prevented.

More specifically, in the embodiment, the fan structure 100 is realized as a blower. Here, along the axial direction X1, with the bottom surface 112 of the center portion 110 as the reference surface, a length L of the center shaft 114 of the center portion 110 along the axial direction X1 is less than the height H of each of the fan blades 120. Furthermore, each of the fan blades 120 has a first end 122 which is close to the center shaft 114 and a second end 124 which is relatively away from the center shaft 114. A distance between the first end 122 and the second end 124 is a chord length S, and a ratio of the height H to the chord length S is greater than 3. That is, the height H of the fan blades 120 of the embodiment is larger. The fan blades 120 may be, for example but not limited to, multiple flat blades, multiple streamline blades, or multiple scroll blades.

To prevent deformation of the fan blades 120 during manufacturing or operation, in the embodiment, the fan blades 120 are fixed with the fixing ring 130 disposed within a range of 40% to 80% of the height H of the fan blades 120. More specifically, referring to FIG. 3, in the embodiment, a thickness W1 of the fixing ring 130 along the axial direction X1 is less than or equal to 10% of the height H so that the structural strength of the fan structure 100 may be maintained, and an air outlet along a radial direction X2 may also be prevented from being blocked. In addition, a thickness W2 of the fixing ring 130 of the embodiment along the radial direction X2 which is perpendicular to the axial direction X1 is less than or equal to 20% of the height H so that the structural strength of the fan structure 100 may be maintained, and an air outlet along the radial direction X2 may also be prevented from being blocked. In addition, as shown in FIG. 1, in the embodiment, the fixing ring 130 substantially protrudes from the second end 124 of the fan blades 120, but it is not limited thereto.

In manufacturing, to release a mold from a core mold and a cavity mold easily, preferably, an orthographic projection of the fixing ring 130 on a plane P does not overlap with an orthographic projection of the bottom surface 112 on the plane P. The plane P is parallel to the bottom surface 112. That is, the fixing ring 130 and the bottom surface 112 of the center portion 110 do not overlap along the axial direction X1. In other words, the center portion 110, the fan blades 120, and the fixing ring 130 of the embodiment may be a structure integrally formed.

Referring to FIG. 3, in the embodiment, a fluid F may enter the fan structure 100 from a side of center shaft 114 which is relatively away from the bottom surface 112 toward the bottom surface 112 along the axial direction X1. When the fluid F enters the fan structure 100, since the fixing ring 130 of the embodiment is disposed within a range of 40% to 80% of the height H of the fan blades 120 instead of being located at the air inlet where high pressure and low pressure meets, the fan blades 120 may be effectively fixed, and noise may also be prevented. In brief, the fan structure 100 of the embodiment reduces noise generated during operation so that the user has a better user experience.

To adequately explain various embodiments of the disclosure, other embodiments of the disclosure are described below. Note that the reference numerals of the elements and a part of the description in the embodiments above are used in the embodiments below in which the same or similar elements are denoted with the same reference numerals. The description of the same technological features will be omitted. With regard to the omitted description, the embodiments above may be referred to, and it will not be repeated in the embodiments below.

Figure 4:
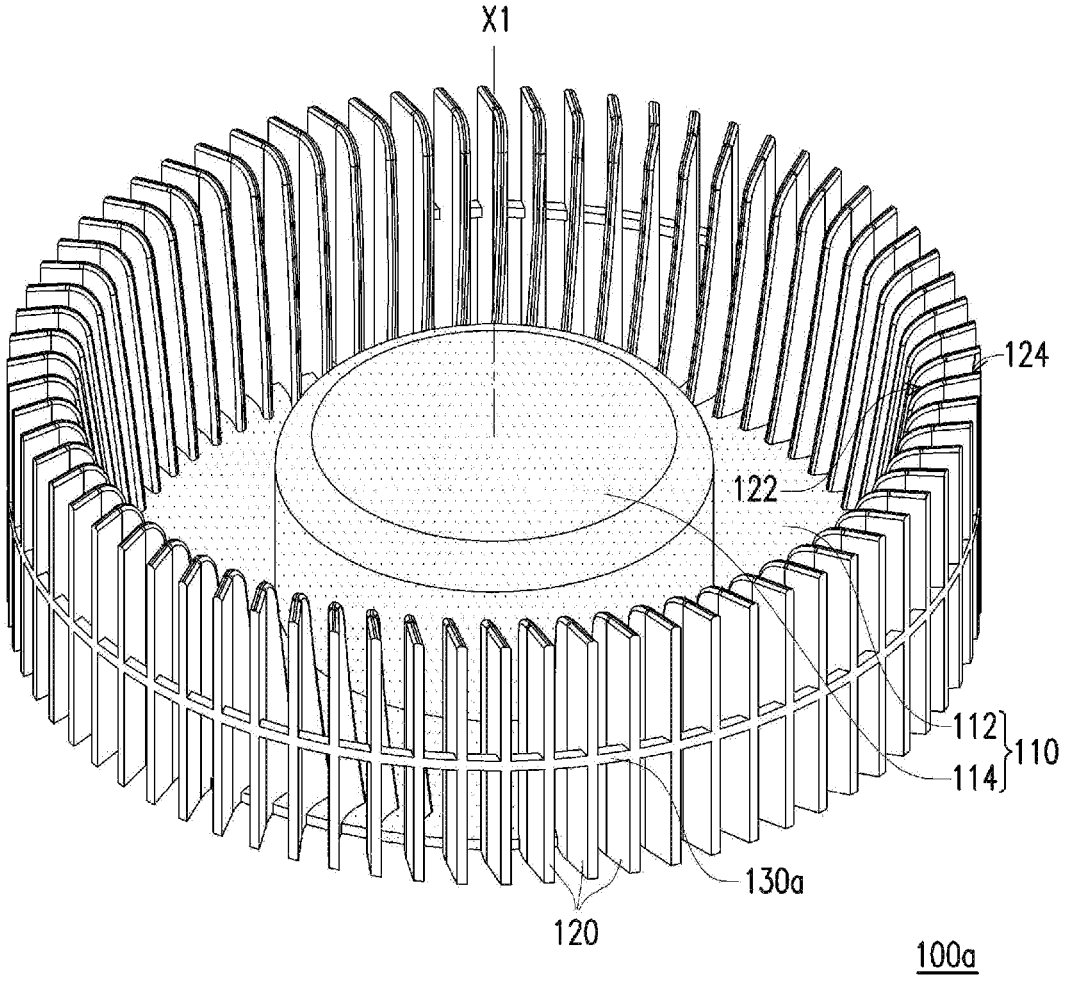
FIG. 4 is a schematic structural diagram of a fan structure according to another embodiment of the disclosure.

FIG. 4 is a schematic structural diagram of a fan structure according to another embodiment of the disclosure. Referring to FIG. 1 and FIG. 4 together, a fan structure 100*a* of the embodiment is similar to the fan structure 100 in FIG. 1. The difference between the fan structure 100*a* and the fan structure 100 is that a fixing ring 130*a* of this embodiment is substantially flush with the second end 124 of the fan blades 120.

In light of the above, the embodiment of the disclosure has at least one of the following advantages or effects. In the fan structure of the disclosure, with the bottom surface of the center portion as the reference surface, the fixing ring is disposed within a range of 40% to 80% of the height of each of the fan blades. That is, the fixing ring of the disclosure is not located at the air inlet where high pressure and low pressure meets so that the fan blades are effectively fixed and noise is also prevented. In summary, the fan structure of the disclosure reduces noise generated during operation so that the user has a better user experience.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A fan structure, comprising a center portion, a plurality of fan blades, and a fixing ring, wherein the center portion comprises a bottom surface and a center shaft, wherein the center shaft is perpendicular to the bottom surface, and a direction in which the center shaft extends is an axial direction;

the fan blades are mutually separated and connected to the bottom surface of the center portion and are disposed around the axial direction, wherein each of the fan blades has a height, and the height is parallel to the axial direction, wherein each of the fan blades has a first end being close to the center shaft and a second end being relatively away from the center shaft; and the fixing ring simultaneously contacts the fan blades at a side of the fan blades being away from the center shaft and is disposed within a range of 40% to 80% of the height of each of the fan blades with the bottom surface of the center portion as a reference surface along the axial direction;

wherein in a radial direction, a distance between an inner periphery of the fixing ring and the center shaft is less than a distance between the second end of each of the fan blades and the center shaft, and a distance between an outer periphery of the fixing ring and the center shaft is greater than the distance between the second end of each of the fan blades and the center shaft; and wherein the center shaft is equidistant from any positon of the inner periphery of the fixing ring in the radial direction, and the radial direction is perpendicular to the axial direction.

2. The fan structure according to claim 1, wherein a distance between the first end and the second end is a chord length, and a ratio of the height to the chord length is greater than 3.

3. The fan structure according to claim 1, wherein a thickness of the fixing ring along the axial direction is less than or equal to 10% of the height.

4. The fan structure according to claim 1, wherein a thickness of the fixing ring along the radial direction being perpendicular to the axial direction is less than or equal to 20% of the height.

5. The fan structure according to claim 1, wherein a length of the center shaft along the axial direction is less than the height of each of the fan blades.

6. The fan structure according to claim 1, wherein the center portion, the fan blades, and the fixing ring are integrally formed.

7. The fan structure according to claim 1, wherein a fluid enters the fan structure from a side of the center shaft being relatively away from the bottom surface toward the bottom surface along the axial direction.

8. The fan structure according to claim 1, wherein the fan blades comprise a plurality of flat blades, a plurality of streamline blades, or a plurality of scroll blades.

9. The fan structure according to claim 1, wherein the fan structure is a blower.

10. The fan structure according to claim 1, wherein an orthographic projection of the fixing ring on a plane does not overlap with an orthographic projection of the bottom surface on the plane, and the plane is parallel to the bottom surface.

* * * * *